US007660546B2

(12) United States Patent
Okano

(10) Patent No.: US 7,660,546 B2
(45) Date of Patent: Feb. 9, 2010

(54) CLEANING DEVICE AND IMAGE FORMING APPARATUS PROVIDED THEREWITH

(75) Inventor: Nobuhiko Okano, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 212 days.

(21) Appl. No.: 11/879,186

(22) Filed: Jul. 16, 2007

(65) Prior Publication Data

US 2008/0056756 A1 Mar. 6, 2008

(30) Foreign Application Priority Data

Sep. 1, 2006 (JP) ..... 2006-237533

(51) Int. Cl.
*G03G 21/00* (2006.01)

(52) U.S. Cl. ..... 399/99; 399/123; 399/353; 399/354

(58) Field of Classification Search ..... 399/99, 399/101, 123, 326, 327, 353, 354
See application file for complete search history.

(56) References Cited

U.S. PATENT DOCUMENTS 6,070,043 A * 5/2000 Fujita et al. ..... 399/313
7,379,686 B2 * 5/2008 Nishikawa ..... 399/101

FOREIGN PATENT DOCUMENTS

JP 2002-40897 2/2002
JP 2006-259367 * 9/2006

* cited by examiner

*Primary Examiner*—Hoan H Tran
(74) *Attorney, Agent, or Firm*—Cantor Colburn LLP

(57) ABSTRACT

A cleaning device for cleaning a transfer sheet conveyance belt, includes: a first brush roll which is provided with voltage with a polarity reverse to a charging polarity of toner particles; and a second brush roll arranged downstream of the first brush roll in a moving direction of the transfer sheet conveyance belt, the second brush roll being provided with the voltage with the same polarity as the charging polarity of the toner particles, while rotating in contact with the surface of the transfer sheet conveyance belt.

8 Claims, 3 Drawing Sheets

CLEANING DEVICE AND IMAGE FORMING APPARATUS PROVIDED THEREWITH

This application is based on Japanese Patent Application No. 2006-237533 filed on Sep. 1, 2006, which is incorporated hereinto by reference.

BACKGROUND OF THE INVENTION

The present invention relates to a cleaning device that uses a brush roller to remove toner attached to a transfer sheet conveyance belt.

In an image forming apparatus using electrophotographic process, a toner image is formed on an image carrier (hereinafter also referred to as "photoreceptor") and this toner image is transferred onto a transfer material (hereinafter also referred to as "transfer sheet"). After that, the transfer sheet carrying the toner image is subjected to a process of fixing by a fixing device. After fixing, the transfer sheet with the image formed thereon is ejected from the image forming apparatus. In this process of transfer, the transfer sheet is conveyed by the transfer sheet conveyance belt and is fed through the transfer section made up of a transfer member arranged to face the photoreceptor through the transfer sheet conveyance belt, whereby the toner image formed on the photoreceptor is transferred onto the transfer sheet.

The transfer sheet conveyance belt is not contaminated by unwanted toner particles since the toner image is hardly formed on the surface thereof in general cases. However, for the portion of the image such as an image control patch to be created on a position of the photoreceptor between transfer sheets and a black band to assist photoreceptor cleaning, even if the transfer member is placed in the non-transfer mode, the toner particles on the photoreceptor may be transferred onto the transfer sheet conveyance belt in some cases, since the photoreceptor is kept in contact with the transfer sheet conveyance belt. Further, if the photoreceptor contains fogged toner particles, the toner particles are transferred onto the transfer sheet conveyance belt in some cases.

The aforementioned unwanted toner particles deposited on the transfer sheet conveyance belt are transferred onto the rear surface of the next transfer sheet to cause contamination in some cases. This makes it essential to clean the transfer sheet conveyance belt for removing the unwanted toner particles deposited on the transfer sheet conveyance belt.

A blade method and a fur brush method wherein a fur brush is used as a brush roll is generally used for the cleaning. In the blade method, an elastic blade such as a rubber blade against the transfer sheet conveyance belt and the toner particles are scraped off mechanically for cleaning. In the fur blush method, a cylindrical substrate with a fur brush attached on the surface is rotated to contact the toner particles on the transfer sheet conveyance belt, and at the same time, the voltage with a polarity reverse to that of toner particles is applied to the brush roll, whereby toner particles are scraped off by electrostatic attraction, and cleaning is performed. The blade method has a problem with durability resulting from turning up of the blade or others. Thus, the fur brush method characterized by a smaller contact load is preferably used.

However, toner particles deposited on the transfer sheet conveyance belt are polarized; for example, they are negatively charged as a whole. Each toner particle, however, may be different in the electric charge amount and the toner particles of reverse polarity (positively charged) are present. FIG. 2 is a diagram representing a typical electric charge amount distribution of negatively charged toner particles. In the fur brush method, cleaning is made by electrostatically attracting toner particles by the brush roll. This makes it possible to clean the toner particles of the polarity (negative) reverse to that (positive) applied to the brush roll. However, the toner particles having the polarity (positive) reverse to that of the toner particles and having a smaller amount of electric charge pass under the brush roll without being removed by cleaning and are deposited on the rear surface of the next transfer sheet, thereby causing contamination.

For the cleaning of the transfer sheet conveyance belt, a proposal has been made of an apparatus wherein a cleaning electric field is formed between the conductive cleaning member arranged in contact with the surface of the belt-shaped member with toner particles deposited thereon, and the conductive opposed member (urging roller) arranged to face the cleaning member through the belt-shaped member, the conductive opposed member has an elastic characteristic, and the cleaning member and elastic opposed member are pressed against each other through a belt-shaped member (for example, see Unexamined Patent Application Publication No. 2002-40897).

In the Unexamined Patent Application Publication No. 2002-40897, voltage with a polarity reverse to a charging polarity of toner particles is applied to the cleaning roller to form the cleaning electric field. This electric field ensures that the toner particles attached to the belt-shaped member are moved toward the cleaning roller member so that the surface of the belt-shaped member is cleaned. Further, the contact pressure between the cleaning member and belt-shaped member is kept constant, thereby maintaining excellent cleaning performances. This arrangement avoids cleaning failure of the transfer sheet conveying member and prevents such a trouble as contamination on the rear of the transfer sheet.

However, as described above, the toner particles having the polarity (positive) reverse to that of the toner particles and having a smaller amount of electric charge pass under the cleaning roll without being removed by cleaning, and are deposited on the rear surface of the next transfer sheet, thereby causing contamination in some case. The Unexamined Patent Application Publication No. 2002-40897 fails to consider the toner particles passing under the cleaning roller and does not mention any solution to this problem.

One aspect of the present invention is a cleaning device for cleaning a transfer sheet conveyance belt, wherein a toner image of an image carrier formed by an image forming section is transferred onto a transfer sheet while the transfer sheet is placed on and conveyed by the transfer sheet conveyance belt, the cleaning device including: a first brush roll rotating in contact with the surface of the transfer sheet conveyance belt, the first brush roll being provided with a voltage with a polarity reverse to a charging polarity of toner particles; and a second brush roll arranged downstream of the first brush roll in a moving direction of the transfer sheet conveyance belt and rotating in contact with the surface of the transfer sheet conveyance belt, the second brush roll being provided with a voltage with the same polarity as the charging polarity of the toner particles.

DETAILED DESCRIPTION OF THE PREFERRED EMBODIMENT

The following describes the embodiment of the cleaning device of the present invention with reference to drawings without the present invention being restricted thereto.

Figure 1:
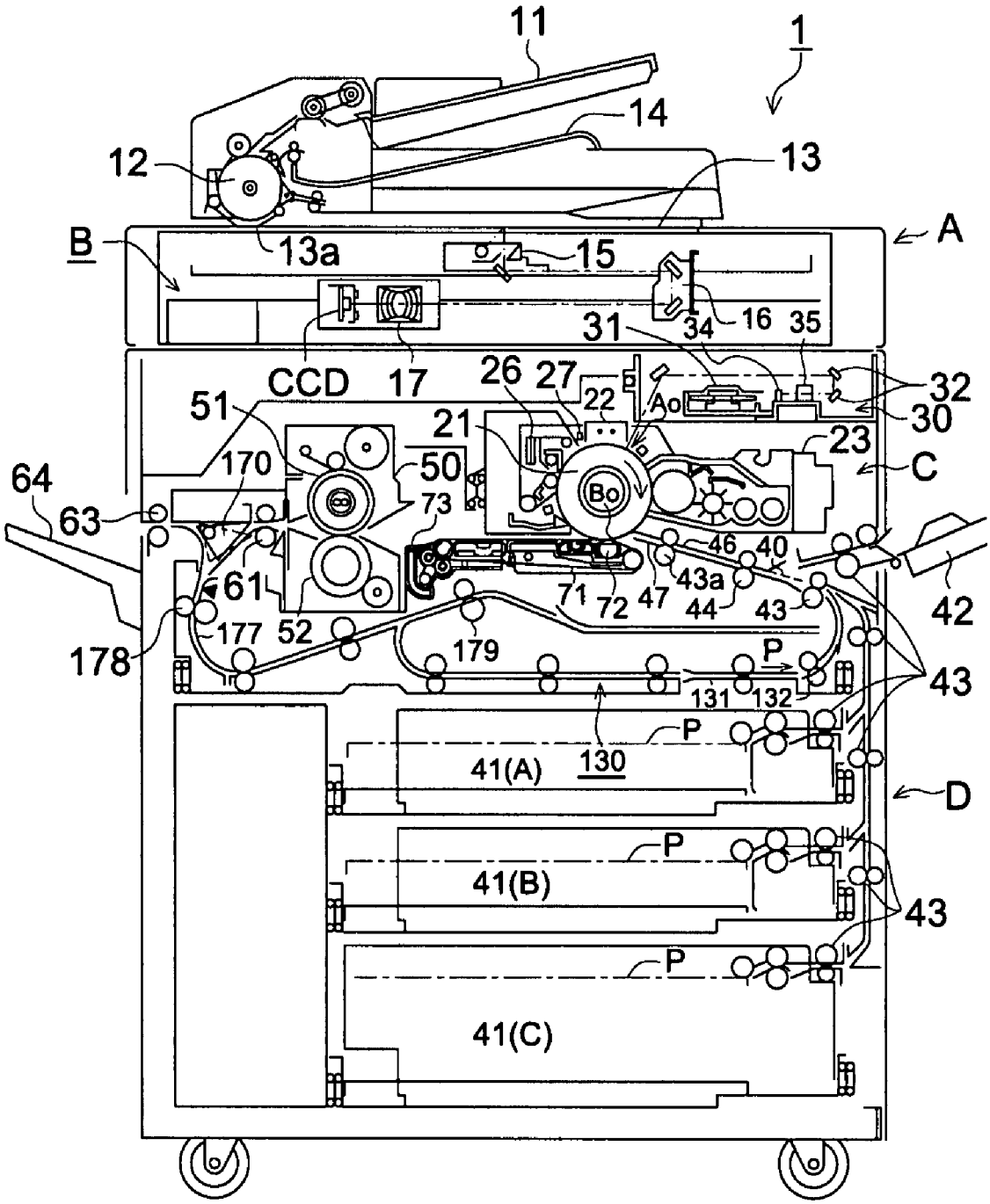
FIG. 1 is a drawing representing an image forming apparatus to which the cleaning device of the present invention is applicable.
Figure 2:
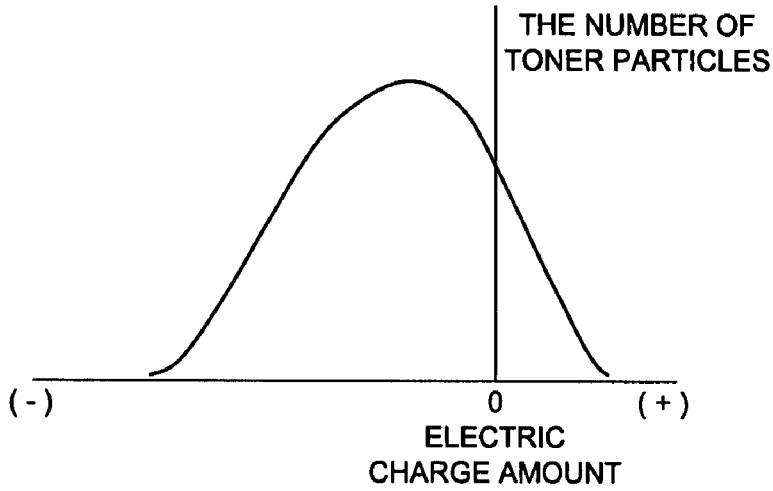
FIG. 2 is a diagram showing the distribution of the amount of electric charge in negatively charged toner particles.

FIG. 1 is a drawing representing an image forming apparatus to which the cleaning device of the present invention is applicable.

The image forming apparatus 1 of FIG. 1 is an image forming apparatus based on a digital system. It includes an image reading section A, an image processing section B, an image forming section C and a transfer sheet conveyance section D as a transfer sheet conveyor. In the present invention, toner particles are negatively charged when they are polarized in the sense described above.

An automatic document feeder for automatically feeding the documents is arranged on the image reading section A. The documents placed on the document placement table are separated and conveyed one by one by a document conveyance roller 12. Then the image is read at the reading position 13*a*. The documents whose images have been read are ejected to a document ejection tray 14 by the document conveyance roller 12.

On the other hand, the image of the document placed on the platen glass 13 is read by the reading operation of a first mirror unit 15 including an illumination lamp and a first mirror, which constitutes an optical scanning system, and by the movement of a second mirror unit 16 including a second mirror and third mirror, which are located in the V-shaped position, in the same direction.

The image that has been read is formed on the light receiving surface of the CCD (Charge Coupled Device), that is an image pickup device as a line sensor, through the projecting lens 17. The linear optical image formed on the image pickup device CCD is subjected to photoelectric conversion and is sequentially converted into electric signals (luminance signals). After that, the signals are subjected to the analog-to-digital conversion and are subjected processes of density conversion and filtering in the image processing section B. Then the image data is temporarily stored in the memory.

In the image forming section C, there are provided, as an image forming unit, a drum-like photoreceptor 21 as an image carrier, a charger 22 for charging the photoreceptor 21, a developing device 23, a photoreceptor cleaning device 26 for the photoreceptor 21 and a PCL (pre-charge lamp) 27 as a discharger, respectively on the periphery of the photoreceptor.

Further, a transfer sheet conveyance belt 71, a transfer member 72, and a cleaning device 73 for cleaning the transfer sheet conveyance belt 71 are provided.

After the rotating photoreceptor 21 has been subjected to uniform charging (negative charging) by the charger 22, imagewise exposure is performed by an exposure optical system as an imagewise exposure unit 30 based on the image signal called out from the memory of the image processing section. In the exposure optical system as an imagewise exposure unit 30 which is a writing unit, a laser diode (not illustrated) is used as a light source, and the optical path of the reflection mirror 32 is bent through a rotating polygon mirror 31, fθ lens 34 and cylindrical lens 35, and thereby primary scanning is performed. Imagewise exposure is performed onto the photoreceptor 21 at position Ao and an electrostatic latent image is formed by the rotation (secondary scanning) of the photoreceptor 21.

The electrostatic latent image on the photoreceptor 21 undergoes reversal development by a developing device 23 and a visible toner image is formed on the surface of the photoreceptor 21.

In the transfer sheet conveyance section D, sheet feed units 41(A), 41(B) and 41(C) as transfer sheet storage units for storing the transfer sheet P are provided below the image forming unit, and a manual sheet feed unit 42 used to feed sheets manually is arranged on the side. The transfer sheet P selected by any of them is sent by a guide roller 43 along the sheet conveyance path 40. After having stopped temporarily by a pair of sheet registration rollers 44 for correcting the skew and misalignment of the transfer sheet P to be fed, the transfer sheet P is fed again to the sheet conveyance path 40, a pre-transfer roller 43*a*, sheet feed path 46 and entry guide plate 47, and is then sent to the transfer sheet conveyance belt 71.

The toner image on the photoreceptor 21 is transferred at transfer position Bo by the transfer member 72 onto the transfer sheet P which is placed on and conveyed by the transfer sheet conveyance belt 71. The transfer member 72 applies to the transfer sheet P the voltage having a polarity (positive) reverse to that of toner particles on the photoreceptor 21, so that the toner image is transferred onto the transfer sheet P. Further, the transfer sheet conveyance belt 71 is also reversely (positively) charged.

Further, the transfer sheet P is separated from the surface of the photoreceptor 21, and is fed to the fixing device 50 by the transfer sheet conveyance belt 71.

The fixing device 50 has a fixing roller 51 and a pressure roller 52. The transfer sheet P is fed between the fixing roller 51 and pressure roller 52, whereby toner particles are fixed by heat and pressure. The transfer sheet P on which a toner image has been fixed is ejected onto the sheet ejection tray 64.

The above description refers to the formation of an image on one side of the transfer sheet. In the case of duplex copying, a sheet ejection switching member 170 is switched, the transfer sheet guide section 177 is opened, and the transfer sheet P is conveyed in the direction marked by the arrow of a broken line.

Further, the transfer sheet P is conveyed downward by the conveyance mechanism 178, and is switched back by the transfer sheet reversing section 179 so that the trailing edge of the transfer sheet P is turned into the leading edge. Under this condition, the transfer sheet P is conveyed into the duplex copying sheet feed unit 130.

The transfer sheet P moves in the direction of sheet feed along the conveyance guide 131 provided on the duplex copying sheet feed unit 130. The transfer sheet P is again fed by the sheet feed roller 132, and is guided to the sheet conveyance path 40.

As described above, the transfer sheet P is again fed in the direction of the photoreceptor 21 and a toner image is transferred on the rear surface of the transfer sheet P. Subsequent to the process of fixing by the fixing device 50, the transfer sheet P is ejected to the sheet ejection tray 64.

The following describes the cleaning device 73 for cleaning the transfer sheet conveyance belt 71 and transfer sheet conveyance belt 71 of the present invention.

Figure 3:
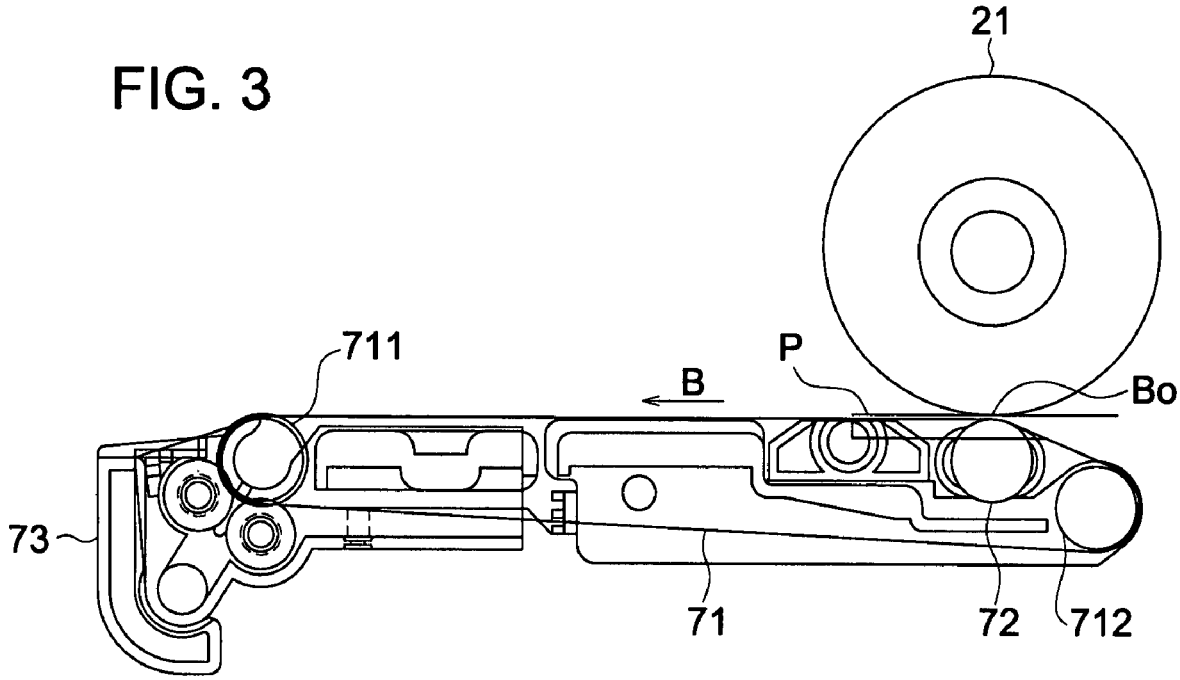
FIG. 3 is a partial diagram showing the vicinity of a transfer sheet conveyance belt and a cleaning device 73.

FIG. 3 is a partial diagram showing the vicinity of a transfer sheet conveyance belt and a cleaning device 73.

The transfer sheet conveyance belt 71 is supported by the drive roller 711 and driven roller 712, and is driven by a drive unit (not illustrated) in the direction indicated by arrow B so that the transfer sheet P is carried and transferred. As to the support of the transfer sheet conveyance belt 71, it is possible to provide a tension member, for example a tension roller, that gives tension to the transfer sheet conveyance belt 71, as required.

A transfer member 72 is arranged at the position to face the photoreceptor 21 inside the transfer sheet conveyance belt 71, wherein this transfer member 72 causes the transfer sheet P to be positively charged so that the toner on the surface of the photoreceptor 21 is transferred to the transfer sheet P. In this embodiment, the transfer roller is used as a transfer member 72. The transfer member 72 is provided with positively charged voltage, and makes rotations while giving pressure applied to the transfer sheet P. This procedure ensures that the toner image formed on the photoreceptor 21 is transferred onto the transfer sheet P.

Figure 4:
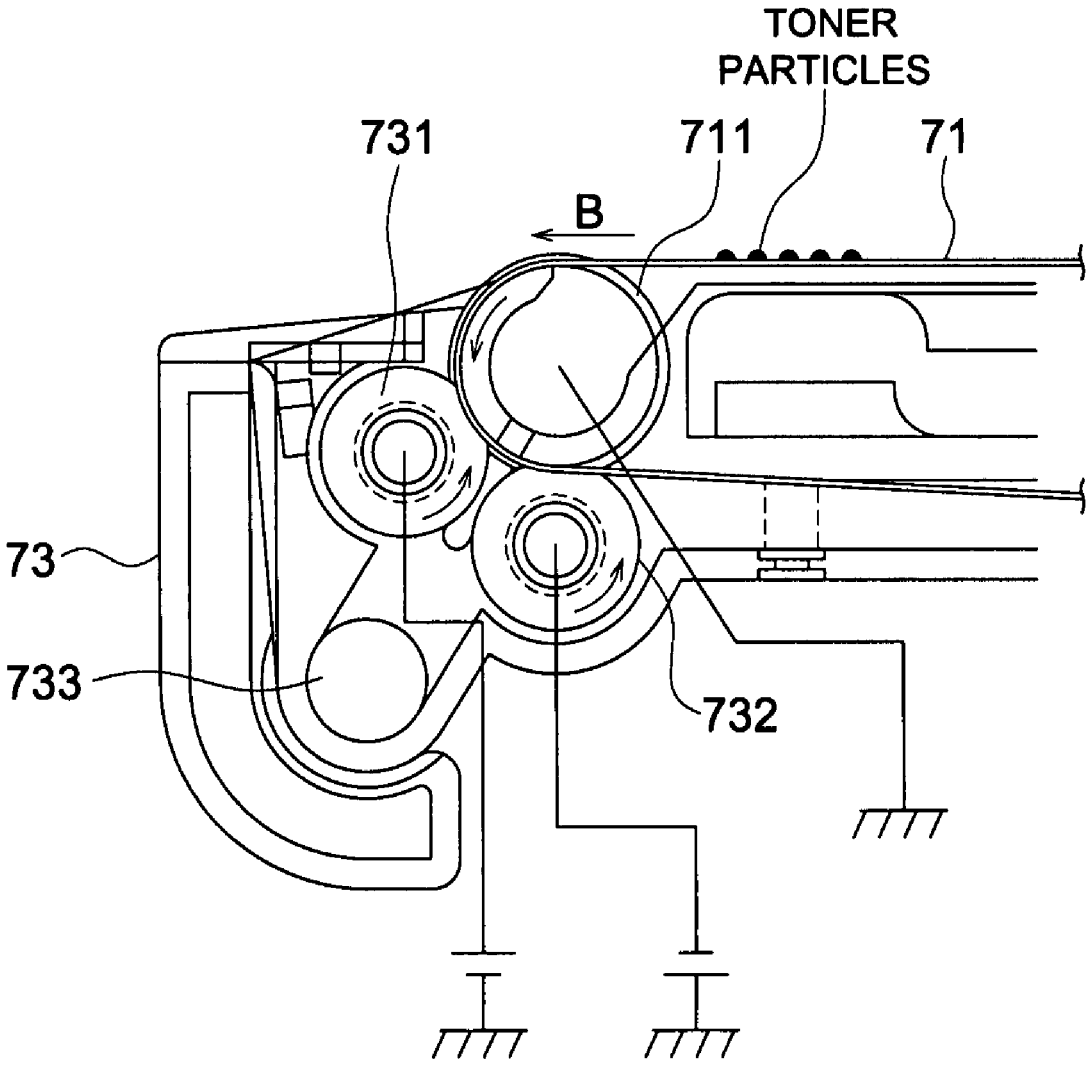
FIG. 4 is an enlarged view of the cleaning device.

FIG. 4 is an enlarged view of the cleaning device 73.

A first brush roll 731 and a second brush roll 732 are arranged at the position to face the drive roller 711 through the transfer sheet conveyance belt 71. The first brush roll 731 is made of the conductive fiber supplied with the voltage of polarity (positive) reverse to the charging polarity (negative/corresponding to normal charging polarity being charged in the developing device) of toner particles, and rotates in contact with the surface of the transfer sheet conveyance belt 71 on the upstream side in the traveling direction of the transfer sheet conveyance belt 71 of the cleaning device 73. The second brush roll 732 is made up of the conductive fiber provided with the voltage of the same polarity (negative polarity) as the toner particles, and rotates in contact with the surface of the transfer sheet conveyance belt 71, on the downstream side in the traveling direction of the transfer sheet conveyance belt 71 of the cleaning device 73. The first brush roll 731 and second brush roll 732 are rotated and driven in the arrow-marked direction, respectively by the drive unit (not illustrated). The aforementioned direction of rotation and drive can be reversed, without being restricted to the arrow-marked direction. Further, the width of the contact of the first brush roll 731 and second brush roll 732 with the transfer sheet conveyance belt 71 is set at a level greater than the maximum width of the transfer sheet P carried and conveyed by the transfer sheet conveyance belt 71.

The toner particles attached to the transfer sheet conveyance belt 71 is electrostatically attracted and is scraped off by the first brush roll 731. The removed toner drops below (toward the conveyance screw 733) in the drawing. It is conveyed in a predetermined direction by the conveyance screw 733, and is stored in the toner recovery section (not illustrated). The negatively charged toner particles are attracted, but the negatively charged toner particles may not be attracted or removed by scraping if they are negatively charged with a small amount of electric charge and are positively charged. They may pass under the first brush roll 731 without being removed.

The toner particles having passed under the first brush roll 731 are partly attracted and removed by scraping by the second brush roll 732, and are made to drop below (toward the conveyance screw 733) in the figure. They are then conveyed in a predetermined direction and are stored in the toner recovery section (not illustrated) by the conveyance screw 733. In the meantime, the toner particles that cannot be removed by the second brush roll 732 are negatively charged to have the amount of electric charge increased by the second brush roll 732. These toner particles characterized by a greater amount of negative charge are deposited on the transfer sheet conveyance belt 71 as residual toner particles. With the movement of the transfer sheet conveyance belt 71, these toner particles travel in the direction in which the transfer sheet P is placed. They are further sent to the transfer position Bo.

The resistance value of the second brush roll 732 is preferably lower than the resistance value of the first brush roll 731. This arrangement ensures that a discharge does not occur easily on the first brush roll 731, and maintains a potential difference between the first brush roll 731 and toner particles so that electrostatic attraction of the toner particles by the first brush roll 731 can be performed effectively. Further, this arrangement allows a discharge to occur easily on the second brush roll 732, thereby ensuring an effective increase in the amount of the electric charge for the toner particles.

The residual toner particles have the amount of negative charge increased by the second brush roll 732. Hence they have an increased force of adhesion with the transfer sheet conveyance belt 71. This makes it possible to ensure that the residual toner particles of the transfer sheet conveyance belt 71 is not transferred onto the rear surface of the transfer sheet P, even when the transfer sheet P is placed on the transfer sheet conveyance belt 71, with the result that contamination on the rear surface of the transfer sheet P is prevented.

Further, the transfer sheet conveyance belt 71 with the residual toner particles kept attached thereon is driven in the direction of the first brush roll 731. As described above, the residual toner particles have a greater increased amount of negative charge. Thus, they are electrostatically attracted by the first brush roll 731 easily, and are scraped off and removed from the transfer sheet conveyance belt 71.

The drive roller 711 is preferably (electrically) grounded. If it is grounded, attraction force of the transfer sheet conveyance belt 71 and transfer sheet P is reduced during the conveyance of the transfer sheet P from the transfer sheet conveyance belt 71 to the fixing device 50. This arrangement ensures easy separation of the transfer sheet P and smooth conveyance of the transfer sheet P to the fixing device 50.

EXAMPLES 1 AND 2

Using the image forming apparatus of FIG. 1, the transfer sheet conveyance belt 71 stained with toner particles was cleaned by the cleaning device 73, and contamination of the transfer sheet conveyance belt 71, contamination of the rear surface of the transfer sheet P and separability of the transfer sheet P were evaluated.

A patch for image control formed between transfer sheets P was formed on the photoreceptor 21, whereby the transfer sheet conveyance belt 71 stained with toner particles was cleaned by the cleaning device 73. Then the transfer sheet P being carried and conveyed by the transfer sheet conveyance belt 71 was made to pass through the transfer position Bo. The transfer sheet P was separated from the transfer sheet conveyance belt 71 and was subjected to the process of fixing by the fixing device 50. Then the transfer sheet P was ejected and checked for contamination on the rear surface by visual observation. After having been cleaned by the cleaning device 73, the transfer sheet conveyance belt 71 was checked for contamination visual observation. Separability was visually examined by checking if the transfer sheet P was jammed or not, and if the ejected transfer sheet P was crumpled or folded. This evaluation was made by passing 50 transfer sheets P through the apparatus.

The following describes the criteria for the evaluation.

(1) Contamination of the Belt and Transfer Sheet:

No contamination observed denotes A;

Contamination observed, but without any practical problem denotes B; and

Contamination observed with practical problem denotes C.

(2) Separability of Transfer Sheet:

50 sheets free from creasing, folding or jamming denotes A; and

One or more of 50 sheets affected by any one of creasing, folding and jamming denotes B.

As shown in Examples 1 and 2 of Table 1, a voltage of +100V through +500V was applied to the first brush roll 731, and a voltage of −100V through −500V was applied to the second brush roll 732. In the Example 1, the drive roller 711 was grounded (GRD). In the Example 2, the drive roller 711 was not grounded (FLOAT).

REFERENCE EXAMPLES 1 AND 2

As shown in the reference Examples 1 and 2 of Table 1, evaluation was made by changing the voltages applied and the grounding conditions of the first brush roll 731, second brush roll 732 and drive roller 711. Other conditions are the same as those of the Example.

Table 1 shows the result of evaluation in the Examples and Reference Examples.

TABLE 1

| | 1st brush roll | 2nd brush roll | Drive (opposed) roller | Contamination of transfer sheet conveyance belt | Contamination on the rear of transfer sheet | Separability of transfer sheet |
|---|---|---|---|---|---|---|
| Example 1 | +100 V | −100 V | GND | A | A | A |
| | +200 V | −200 V | GND | A | A | A |
| | +300 V | −300 V | GND | A | A | A |
| | +400 V | −400 V | GND | A | A | A |
| | +500 V | −500 V | GND | A | A | A |
| Example 2 | +100 V | −100 V | Float | B | A | B |
| | +200 V | −200 V | Float | B | A | B |
| | +300 V | −300 V | Float | A | A | B |
| | +400 V | −400 V | Float | A | A | B |
| | +500 V | −500 V | Float | A | A | B |
| Reference | GND | GND | GND | C | A | A |
| Example 1 | GND | +100 V | GND | A | A | A |
| | GND | +200 V | GND | A | B | A |
| | GND | +300 V | GND | B | C | A |
| | GND | +500 V | GND | C | C | A |
| Reference | +100 V | GND | GND | C | C | A |
| Example 2 | +200 V | GND | GND | C | C | A |
| | +300 V | GND | GND | C | C | A |
| | +400 V | GND | GND | B | B | A |
| | +500 V | GND | GND | A | A | A |

As shown in Table 1, in the Examples 1 and 2, excellent results were recorded in the test of cleaning the transfer sheet conveyance belt 71 without contamination on the rear of the transfer sheet P. As shown in Examples 1 and 2, a wide range is available to apply voltages, and this makes it possible to meet a change in the stage of deposition of the toner particles resulting from a change in environmental conditions such as humidity.

The drive (opposed) roller is preferably grounded. In Example 2, a problem was found in the separability of the transfer sheet. The drive roller 711 of Example 2 is not grounded, and therefore, the suction force of the transfer sheet conveyance belt 71 and transfer sheet P cannot be reduced. This may affect the separation of the transfer sheet P. Thus, the drive (opposed) roller is preferably grounded, from the viewpoint of separability of the transfer sheet, as shown in Example 1.

In the Reference Examples 1 and 2, the range of setting the applied voltage is so limited that it is impossible to meet a change in the stage of deposition of the toner particles resulting from a change in environmental conditions such as humidity.

What is claimed is:

1. A cleaning device that cleans a transfer sheet conveyance belt, wherein a toner image of an image carrier formed by an image forming section is transferred onto a transfer sheet while the transfer sheet is placed on and conveyed by the transfer sheet conveyance belt, the cleaning device comprising:

(a) a first brush roll rotating in contact with the surface of the transfer sheet conveyance belt, the first brush roll being provided with a voltage with a polarity reverse to a charging polarity of toner particles; and (b) a second brush roll arranged downstream of the first brush roll in a moving direction of the transfer sheet conveyance belt and rotating in contact with the surface of the transfer sheet conveyance belt, the second brush roll being provided with a voltage with the same polarity as the charging polarity of the toner particles; and (c) wherein resistance value for the second brush roll is lower than that for the first brush roll.

2. The cleaning device of claim 1, wherein the first brush roll removes the toner particles from the surface of the transfer sheet conveyance belt.

3. The cleaning device of claim 1, wherein the second brush roll increases an amount of electrical charge of the toner particles in the same polarity as the polarity of the voltage of the second brush roll.

4. An image forming apparatus comprising:

a cleaning device that cleans a transfer sheet conveyance belt, wherein a toner image of an image carrier formed by an image forming section is transferred onto a transfer sheet while the transfer sheet is placed on and conveyed by the transfer sheet conveyance belt, the cleaning device comprising:

(a) a first brush roll rotating in contact with the surface of the transfer sheet conveyance bell, the first brush roll being provided with a voltage with a polarity reverse to a charging polarity of toner particles; and (b) a second brush roll arranged downstream of the first brush roll in a moving direction of the transfer sheet conveyance belt and rotating in contact with the surface of the transfer sheet conveyance belt, the second brush roll being provided with a voltage with the same polarity as the charging polarity of the toner particles; and (c) wherein resistance value for the second brush roll is lower than that for the first brush roll.

5. The image forming apparatus of claim 4, wherein the transfer sheet conveyance belt is supported by a plurality of support members, and at least one of the plurality of support members which is arranged to face at least one of the first brush roll and the second brush roll is grounded.

6. The image forming apparatus of claim 5, wherein the transfer sheet is separated from the transfer sheet conveyance belt on the grounded support member.

7. The image forming apparatus of claim 6, wherein the grounded support member is a drive roller.

8. The image forming apparatus of claim 4, wherein the transfer sheet conveyance belt includes a transfer member which charges the transfer sheet to the polarity reversed to the charging polarity of the toner particles.

* * * * *